United States Patent [19]

Brueckner et al.

[11] 4,216,600

[45] Aug. 12, 1980

[54] TELESCOPIC SIGHT MOUNT

[76] Inventors: Gerald G. Brueckner, 16135 Timberview, Fraser, Mich. 48026; Edward Cantrell, 31251 Beechwood, Warren, Mich. 48093

[21] Appl. No.: 949,564

[22] Filed: Oct. 10, 1978

[51] Int. Cl.³ ..... F41G 1/38

[52] U.S. Cl. ..... 42/1 ST; 33/250

[58] Field of Search ..... 42/1 ST; 33/245, 247, 33/248, 250

[56] References Cited

U.S. PATENT DOCUMENTS

| | | | |
|---|---|---|---|
| 1,816,195 | 7/1931 | Redfield | 42/1 ST |
| 2,445,595 | 7/1948 | Bengert | 42/1 ST |
| 2,493,254 | 1/1950 | Leupold | 33/248 |
| 2,743,525 | 5/1956 | Leupold | 33/248 |
| 3,406,455 | 10/1968 | Akin, Jr. | 33/245 |

*Primary Examiner*—Charles T. Jordan

*Attorney, Agent, or Firm*—Gifford, Van Ophem, Sheridan & Sprinkle

[57] ABSTRACT

A telescopic sight mount is provided in which no troque is applied to the telescope when mounted. The torque-free installation is accomplished by having a front and rear telescopic mount which engage the telescopic sight and float freely and also by having a rotatably adjustable eccentric union attached to the rear telescopic sight mount. The telescope sight is aligned with the barrel sight by adjusting or rotating the eccentric union. Thereafter, all screws are securely tightened. Since no torque is used during installation, there is no tension on the external telescopic cylinder and no distortion of the lens system, either temporarily during installation or permanently after securing.

9 Claims, 13 Drawing Figures

TELESCOPIC SIGHT MOUNT

BACKGROUND OF THE INVENTION

I. Field of the Invention

The present invention relates to an improved telescopic sight mount.

II. Description of the Prior Art

Most previously known telescopic sight mounts are attachable to the rifle barrel in a preset and predetermined position and include both a front and rear mount. Each mount further includes a split ring between which the telescopic sight is entrapped.

For true accuracy in operation, however, a telescopic sight must be mounted to the barrel of a rifle such that the axis of the telescopic sight is parallel to the axis of the rifle bore. Consequently, the axis of the sight with these previously known mounts will be parallel with the rifle bore only if the rifle bore is true to the sight mount holes of the barrel. However, true alignment of the rifle bore to the sight mount holes in the barrel is the exception, rather than the rule. Therefore, the telescopic sight must be aligned with rifle bore to obtain the desired accuracy.

In the installation of telescopes, these previously known telescopic sight mounts thus require the use of considerable lateral force to align the telescope with the rifle barrel. To rotate the sight mounting ring on the front sight mount, the force is initially applied conventionally with a bar, but in the final adjustment, the force is frequently applied to the telescope itself. In many instances, the residual torque places considerable tension on the external cylinder or housing of the telescope, and causes varying distortion of the telescopic sight lens system. This also increases the possibility of damage to the sight if sudden force or shock is applied to the telescopic sight as would occur if the weapon were accidientally dropped.

To reduce the effect of this lateral torque, some gunsmiths use milling machines for installation of the telescopic sight mounts and the telescopic sight. This procedure is disadvantageous in that it requires considerable time and expense.

In addition, the telescopic sight mount screw holes in the barrel and receiver frequently are not centered and occasionally the eccentrically exceeds the windage or lateral adjustment of the telescopic reticle. When this occurs, the mounting holes must be plugged and relocated on the barrel and/or receiver.

SUMMARY OF THE PRESENT INVENTION

Accordingly, an object of the present invention is an improved mount for installing a telescopic sight in which no torque is applied and, therefore, no tension on the external cylinder, no possible distortion of the lens system, and no susceptibility to damage or displacement if accidentally dropped or hit or from repeated shocks of recoil due to heavy powder loads.

In brief, the present invention comprises a front mount and a rear mount, both of which include a base secured to the rifle barrel. Each mount further includes a split ring arrangement between which a telescopic sight is entrapped.

The lower split ring half of the front mount is secured to its base by a pin which permits the lower split ring half to freely rotate about the pin. When positioned as desired, locking screws rigidly secure the split ring arrangement to the pin and thus to the mount base.

Conversely, the lower split ring half of the rear mount is joined to its base by means of an eccentric union, the rotation of which laterally displaces the rear split ring arrangement until the telescopic sight is brought into alignment with the rifle bore. Locking screws then rigidly secure the rear split ring arrangement to the eccentric union and also secure the eccentric union to its base.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
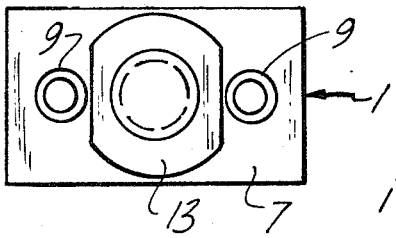
FIG. 1 is a top view of the front sight mount for the telescopic sight mount assembly of the present invention.

The telescopic sight mount assembly of the present invention comprises a front sight mount 1, a rear sight mount 2, an eccentric union 3, split rings 4 which preferably, but not necessarily are interchangeably compatible with the front and rear sight mounts, socket head screws 5 and setscrews 6. The counterbored holes for the front and rear bases will typically be identical. Likewise, the setscrew holes and the setscrews will have uniform diameters, but variable lengths while the grooves in the cylinders will have uniform dimensions, preferably.

Figure 2:
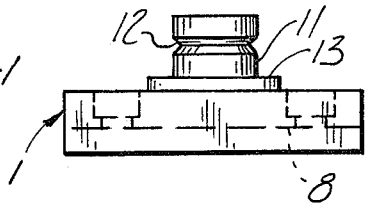
FIG. 2 is a side view of the front sight mount for the telescopic sight mount assembly of the present invention.
Figure 3:
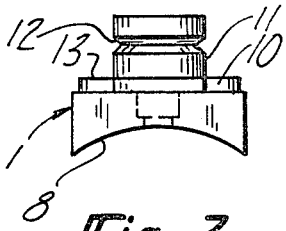
FIG. 3 is a front view of the front sight mount for the telescopic sight mount assembly of the present invention.
Figure 13:
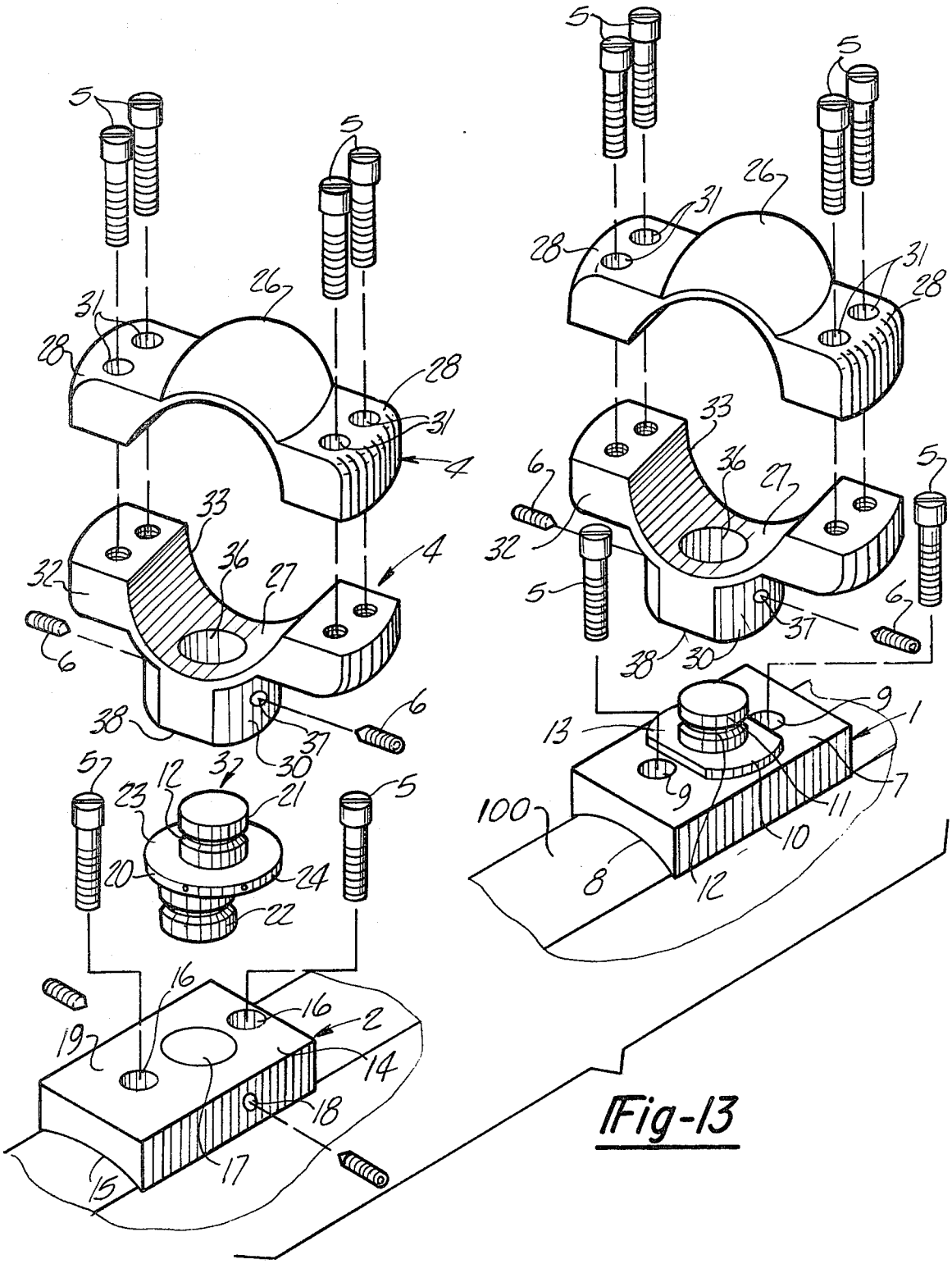
FIG. 13 is an exploded view of the entire telescopic sight mount assembly of the present invention and shown mounted to a rifle.

FIGS. 1, 2 and 3 represent the top, side and front views of a portion of the front sight mount 1 which includes a base 7 which will have a size and shape which will correlate well with the weapon receiver or barrel and which will render an overall conforming appearance. A concave lower surface 8 of the base 7 conforms to, but is slightly shorter than, the convex surface of the receiver or barrel, thereby allowing a more stable attachment at the lateral edges of the base 7 to compensate for any imperfection of the receiver or barrel convex surface. Counterbored holes 9 are provided through the base 7 for attaching the front sight mount 1 to the receiver or barrel assembly of the weapons with suitable socket head screws 5 (FIG. 13). The height of the base 7 furthermore will be compatible with the rear sight mount 2, and will be such as to minimize weight without sacrificing stability or durability.

A cylinder 11 extends upwardly from the base 7 and includes an annular V-groove 12 formed therearound. A circular shoulder 10 on the base 7 will vary in height to determine the overall elevation of the telescopic sight as will become shortly apparent. The circular shoulder 10 will have a planar upper surface 13 on which the planar base 38 of a telescopic split ring assembly 4 (FIG. 12), which will later be described in greater detail, will conform precisely and rest securely. The cylinder 11, onto which the ring 4 is slid and is rotated, has its V-groove 12 set below setscrew holes 37 formed in the ring 4 to produce downward traction on the ring assembly when pointed setscrews 6 in the bores 37 are tightened.

Figure 4:
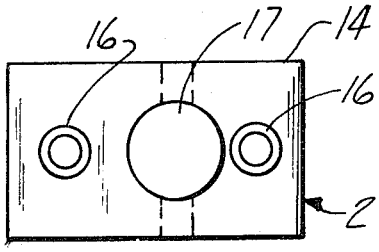
FIG. 4 is a top view of the rear sight mount for the telescopic sight mount assembly of the present invention.
Figure 5:
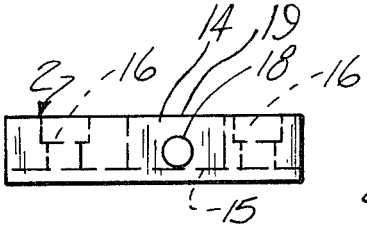
FIG. 5 is a side view of the rear sight mount for the telescopic sight mount assembly of the present invention.
Figure 6:
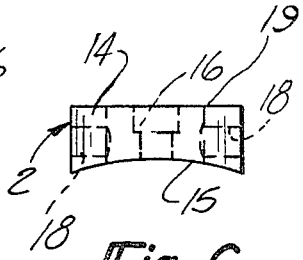
FIG. 6 is a front view of the rear sight mount for the telescopic sight mount assembly of the present invention.

Represented in FIGS. 4, 5 and 6 are the top, side and front view of a base 14 for the rear sight mount 2. The base 14 will have a size and shape which will correlate well with the weapon receiver and which will render an overall conforming appearance. A lower concave surface 15 of the base 14 will conform to, but be slightly shorter than, the mating convex surface of the receiver or barrel. Counterbored holes 16 are formed through the base 14 for attaching the rear sight mount 2 to the receiver or barrel assembly of the weapon with socket head screws 5. As with the front sight mount 1, the height of the base 14 will be compatible with, but not necessarily identical to, the height of the base 7 of the front sight mount 1, and will be such as to minimize weight without sacrificing stability or durability.

Figure 8:
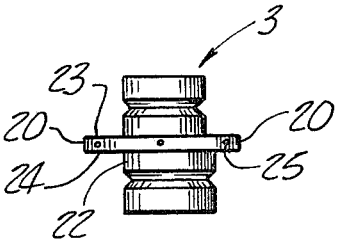
FIG. 8 is a side view of the eccentric union for the rear sight mount for the telescopic sight mount assembly of the present invention.

The base 14 includes a laterally centered hole 17 into which a lower segment 22 of the eccentric union 3, subsequently described, is inserted. The upper surface 19 of the base 14 is planar and flatly abuts against a lower planar surface 24 of a shoulder 20 on the eccentric union 3 (FIG. 8). The base 14 further contains two threaded lateral holes 18 which are located at the mid-height between the upper planar surface 19 and the top of the concave surface 15. The holes 18 threadably receive pointed set screws 6 which abut against the eccentric union as will be shortly described.

Figure 7:
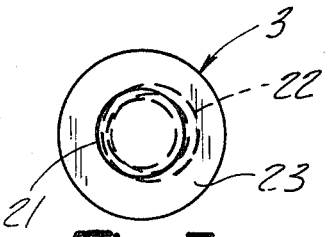
FIG. 7 is a top view of the eccentric union for the rear sight mount for the telescopic sight mount assembly of the present invention.
Figure 9:
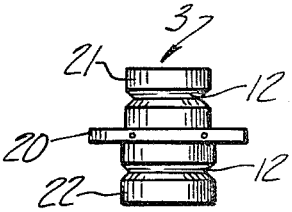
FIG. 9 is a front view of the eccentric union for the rear sight mount for the telescopic sight mount assembly of the present invention.
Figure 12:
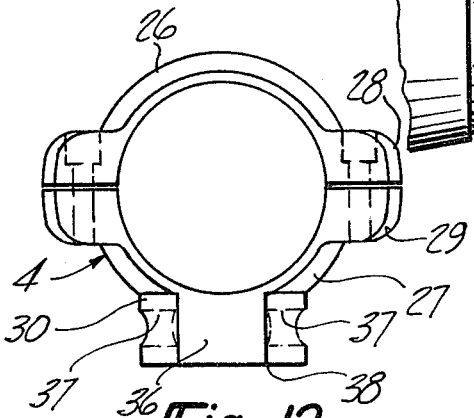
FIG. 12 is a side view of the telescopic split rings for the front and rear sight mounts for the telescopic sight mount assembly of the present invention.

FIGS. 7, 8 and 9 illustrate the top, side and front views of the eccentric union 3. The eccentric union 3 has a circular central shoulder 20 with preferably circumferentially equally spaced holes 25 at the midheight for rotational adjustment. Other means for adjustment may also be employed, including, for example, equally spaced sides, such as a hexahedron, or a circular knurled surface. The top and bottom surfaces 23 and 24 respectively of the shoulder 20 are planar and conform precisely to and flatly abut against the planar upper surface 19 of the rear sight mount base 14 and on the planar base 38 of the neck 30 of the telescopic split ring assembly 4 (FIG. 12). The height (thickness) of the shoulder 20 will be compatible with, but not necessarily identical to, the height of the circular shoulder 10 on the front sight mount 1.

The union 3 includes an upper cylinder 21 onto which the split ring assembly 4 is slid and is rotated and which is coaxial or centered with the shoulder 20. An annular V-groove 12 set below the setscrew holes 37 in the ring assembly 4 is formed around the cylinder and produces downward traction on the ring assembly 4 when pointed setscrews 6 are screwed into the bores 37 and tightened against the V-groove in the cylinder 21.

The union 3 further comprises a downwardly extending cylinder 22 having an axis eccentric to the shoulder 20 and thus, to the cylinder 21. The cylinder 22 is rotatably mounted in the hole 17 of the base 14 and upon rotation, laterally adjusts for windage of the telescope by laterally moving the upper cylinder 21. A V-groove 12 formed around the cylinder 21 is set above the setscrew holes 18 in the base 14 to produce downward traction on the union 3 upon tightening the pointed setscrews 6 in the base holes 18.

Figure 10:
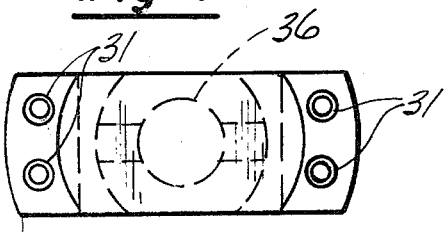
FIG. 10 is a top view of the telescopic split ring for the front and rear sight mounts for the telescopic sight mount assembly of the present invention.
Figure 11:
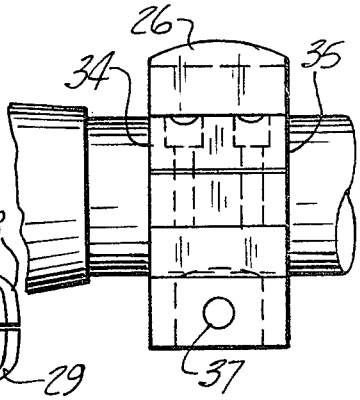
FIG. 11 is a front view of the telescopic split rings for the front and rear sight mounts for the telescopic sight mount assembly of the present invention.

In FIGS. 10, 11 and 12, the ring assembly 4 is shown in the top, front and side views and is substantially the same for both the front and rear sight mounts. An upper ring segment 26 is semicircular in shape and includes a shoulder 28 having counterbored holes 31 which receive socket head screws 5. A lower ring segment 27 is also semicircular in shape and is compatible and congruous with the upper ring segment 26 in radius, wall, shoulder and screw holes 31, the latter of which are threaded and not counterbored. A neck 30 is integrally formed with the lower ring segment 27 and is essentially cylindrical in shape. A hole 36 is coaxially formed through the entire height of the neck 30. The hole 36 in one ring assembly 4 is positioned over the cylinder 11 on the front sight mount 1 while the neck hole 36 on the second ring assembly is positioned over the upper cylinder 21 of the eccentric union 3 on the rear sight mount. The neck 30 has lateral threaded screw holes 37 which receive setscrews 6 for securing the ring assemblies 4 to the cylinders 11 and 21. The neck 30 further has a planar lower surface 38 which flatly abuts against the planar surfaces 13 and 23 of the shoulders 10 and 20 of the front sight mount 1 and the eccentric union 3 respectively.

The sight mount of the present invention is shown in FIG. 13 secured to the barrel of a rifle. Although its assembly should by now be apparent, in brief the front and rear bases 7 and 14 are first secured to the barrel 100 by the screws 5. The front ring assembly 4 is rotatably mounted over the cylinder 11 while the rear ring assembly 4 is rotatably mounted onto the upper cylinder 21 of the eccentric union 3. A telescopic sight (not shown) is secured and entrapped between the ring assemblies 4 in the standard fashion although the ring screws 5 for at least one of the ring assemblies 4 are not yet tightened.

Rotation of the eccentric union laterally shifts or displaces the rear end of the telescopic sight thus bringing the axis of the sight into alignment with the rifle barrel 100. In doing so, however, no torque force is exerted against the telescopic sight. When properly aligned, the setscrews are tightened against the cylinders 11, 21 and 22 to thereby lock the sight mount against further movement.

The telescopic sight mount described herein is an example only of the invention, which may be modified to equivalent embodiments within the confines of the invention, and which are limited only by the breadth of the claims appended below. Although the design of this invention is intended for applications to weapons, it shall be understood that the design is capable of modification to adapt this invention to other optical and/or nonoptical devices.

We claim:

1. A telescopic sight mount assembly for securing a telescopic sight to a device, said assembly comprising:

a first mount and a second mount, each mount including a base;

means for attaching said bases to said device in a spaced relationship;

a first telescopic sight supporting means and first means for rotatably securing said first sight supporting means to said first base;

a second telescopic sight supporting means and second means for securing said second sight supporting means to said second base, said second securing means including an eccentric member the rotation of which laterally displaces said second supporting means with respect to the first supporting means.

2. The invention as defined in claim 1 wherein said eccentric member further comprises a first cylinder rotatably positioned in a bore in the first base and a second cylinder rotatably positioned in a bore in the first supporting means, each cylinder having an axis which is parallel to and spaced from the other cylinder.

3. The invention as defined in claim 1 wherein each supporting means further comprises a pair of substantially semicircular rings and means for detachably securing said rings together and around a telescopic sight.

4. The invention as defined in claim 1 wherein said first securing means comprises a cylinder secured to said first base and rotatably positioned in a bore in said first supporting means.

5. The invention as defined in claim 4 wherein said first and second supporting means are substantially identical to each other.

6. The invention as defined in claim 2 wherein said eccentric member further comprises an outwardly protruding flange disposed between said cylinders and means formed on said flange for rotating said eccentric member.

7. The invention as defined in claim 6 and including means for locking said eccentric member to said second base, said locking means comprising at least one screw threadably engaging said second base and having a nose which abuts against the lower portion of a V-shaped groove formed around said first cylinder so that, upon tightening, said screw urges said flange against said base.

8. The invention as defined in claim 7 and including further means for locking said eccentric member to said second supporting means, said further locking means comprising a further screw threadably engaging said second supporting means and having a nose which abuts against the upper portion of a V-shaped groove formed around said second cylinder so that, upon tightening, said further screw urges said second supporting means toward and against said flange.

9. The invention as defined in claim 4 and including locking means for locking said cylinder to said first supporting means, said locking means comprising at least one screw threadably engaging said first supporting means and having a nose which abuts against the upper portion of a V-shaped groove formed around said cylinder so that, upon tightening, said screws urge said first supporting means against said first base.

* * * * *